US007128697B1

(12) United States Patent
Krull

(10) Patent No.: US 7,128,697 B1
(45) **Date of Patent: *Oct. 31, 2006**

(54) EXERCISE WEIGHT SELECTION METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 54 days.

This patent is subject to a terminal disclaimer.

(21) Appl. No.: 10/863,050

(22) Filed: Jun. 7, 2004

Related U.S. Application Data

(63) Continuation of application No. 09/745,823, filed on Dec. 21, 2000, now Pat. No. 6,746,381.

(60) Provisional application No. 60/171,813, filed on Dec. 21, 1999.

(51) Int. Cl.
*A63B 21/072* (2006.01)

(52) U.S. Cl. ..... 482/108; 482/107

(58) Field of Classification Search ..... 482/93, 482/97–98, 106–108; D21/680–683
See application file for complete search history.

(56) References Cited

U.S. PATENT DOCUMENTS

| | | | | |
|---|---|---|---|---|
| 5,779,604 | A * | 7/1998 | Towley et al. | 482/108 |
| 6,149,558 | A * | 11/2000 | Chen | 482/107 |
| 6,186,928 | B1 * | 2/2001 | Chen | 482/107 |
| 6,196,952 | B1 * | 3/2001 | Chen | 482/107 |
| 6,228,003 | B1 * | 5/2001 | Hald et al. | 482/107 |
| 6,746,381 | B1 * | 6/2004 | Krull | 482/108 |

* cited by examiner

*Primary Examiner*—Gregory L. Huson
*Assistant Examiner*—Fenn C. Mathew

(57) ABSTRACT

Exercise dumbbells have pairs of weights disposed at opposite ends of a handle. Selector rods are selectively movable into engagement with various combinations of the weights.

6 Claims, 8 Drawing Sheets

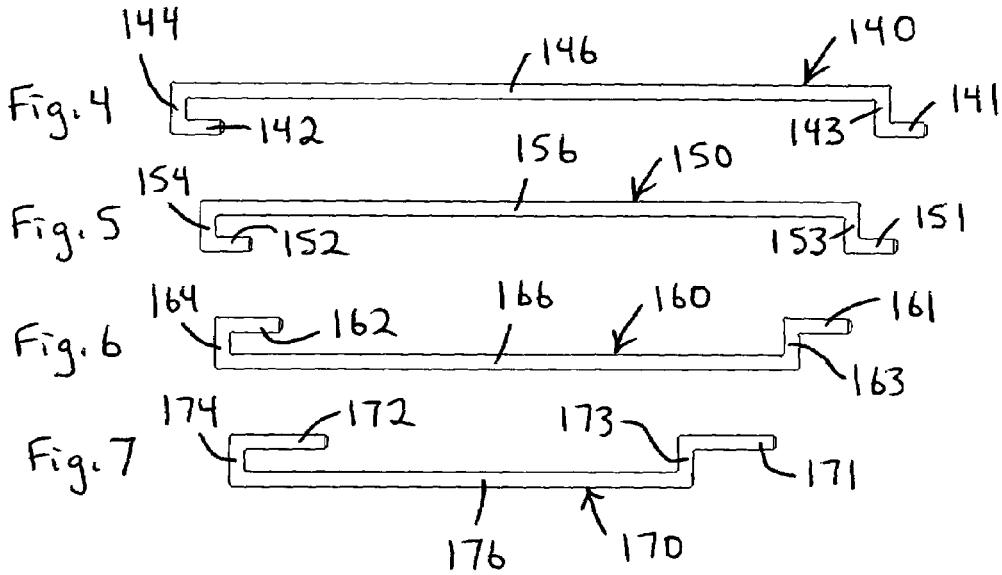
Fig. 4
144
146
140
142
143
141
Fig. 5
154
156
150
152
153
151
Fig. 6
164
162
166
160
161
163
Fig. 7
174
172
173
171
176
170
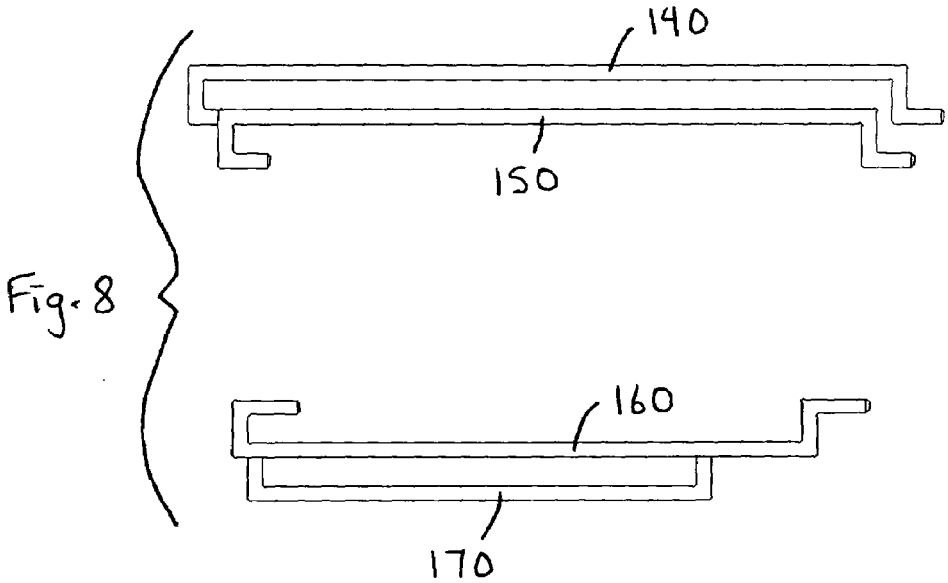
Fig. 8
140
150
160
170

245
240
241
247
1.25 pounds 140
104
120

240
240
251
250
254
257
2.5 pounds 150
105
120

250
250
260
261
264
267
5 pounds 160
106
120

260
260
270
276
271
10 pounds 170
107
120

270
270

550
554
553
551

553
554
550

553
554
550

500
525
520
526
519
510
529
512
512

560
561
565
566

566
560
565

565
566
560

Fig. 35
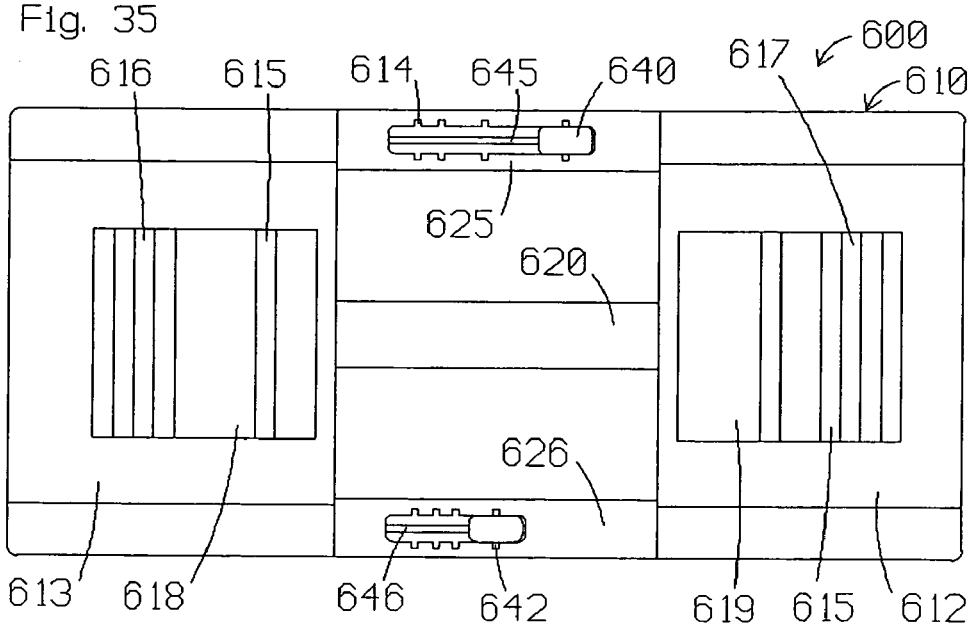
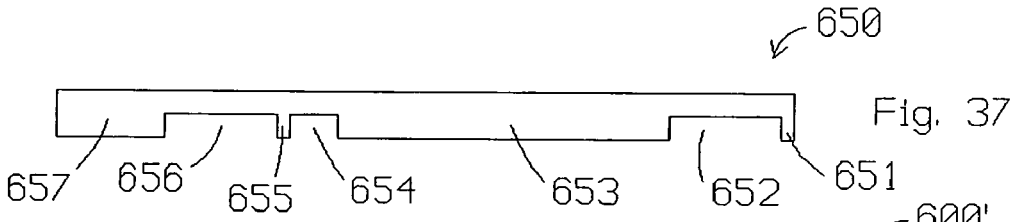
Fig. 37
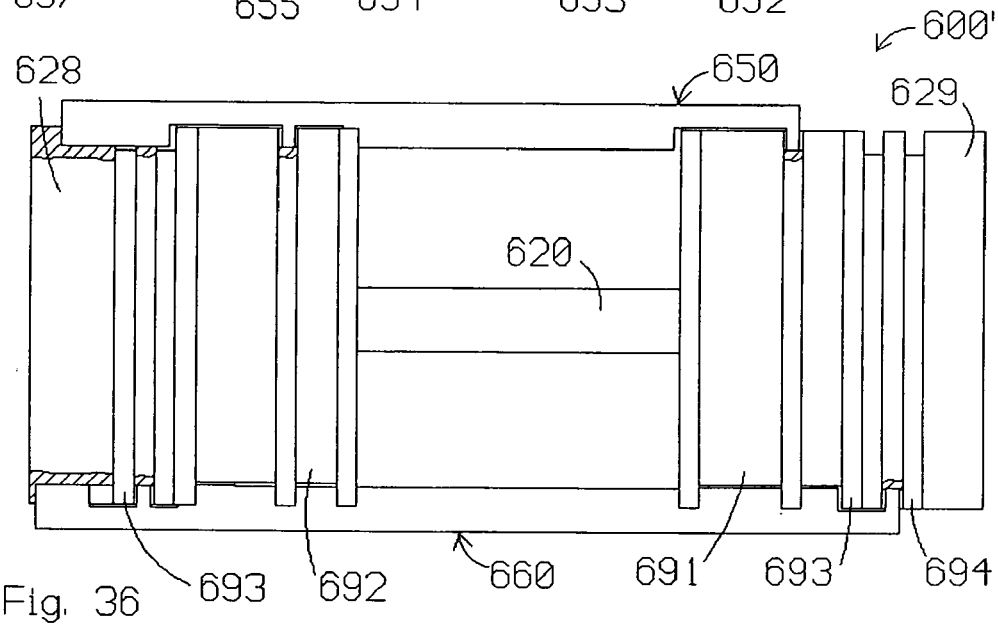
Fig. 36
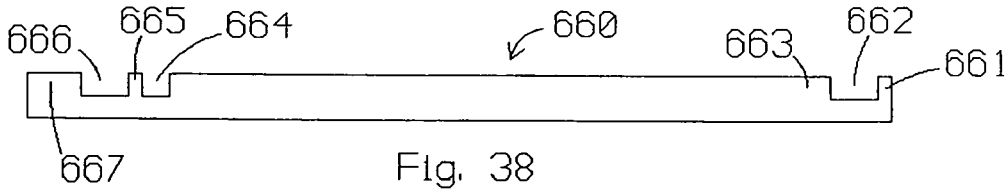
Fig. 38

EXERCISE WEIGHT SELECTION METHODS AND APPARATUS

CROSS-REFERENCE TO RELATED APPLICATIONS

This is a continuation of U.S. patent application Ser. No. 09/745,823, filed on Dec. 21, 2000 (now U.S. Pat. No. 6,746,381), which claims the benefit of U.S. Provisional No. 60/171,813, filed on Dec. 21, 1999.

FIELD OF THE INVENTION

The subject invention relates to exercise weight selection methods and apparatus, and is particularly well-suited for use in connection with exercise dumbbells.

BACKGROUND OF THE INVENTION

Exercise dumbbells are well known in the art and prevalent in the exercise equipment industry. Generally speaking, each dumbbell includes a handle and a desired number of weights or plates which are typically secured to opposite ends of the handle. The dumbbell is lifted up subject to gravitational force acting on the mass of the handle and any attached weights.

Some prior art dumbbells are made as fixed weights, and some people seem to prefer fixed weight dumbbells, perhaps because they are simple to use and solid in construction. However, a disadvantage of fixed weight dumbbells is that numerous such dumbbells are required to provide a range of weight resistance.

Other prior art dumbbells include handles and weight plates that the user is able to add to and/or remove from the handles. These variable weight dumbbells provide an economy of scale because only a few weights may be combined in a variety of ways to provide a range of weight resistance. On the other hand, these variable weight dumbbells require time to change between levels of weight resistance (particularly since a change is typically made to each end of two separate handles), and the loose weight plates present a storage problem, as well.

Still other prior art, adjustable weight dumbbells (and barbells) do not require the user to handle the weight plates during changeovers, and they maintain the weight plates in orderly fashion when not in use. Examples of these more sophisticated, "self-adjusting" free weight assemblies are disclosed in U.S. Pat. No. 4,284,463 to Shields (discloses a dumbbell assembly having opposite side weights which are maintained in alignment on a base and selectively connected to a handle by means of cam driven pins on the weights); U.S. Pat. No. 4,529,198 to Hettick, Jr. (discloses a barbell assembly having opposite side weights which are maintained in alignment on respective storage members and selectively connected to a handle by means of axially movable springs); U.S. Pat. No. 4,822,034 to Shields (discloses both barbell and dumbbell assemblies having opposite side weights which are maintained in alignment on a shelf and selectively connected to a handle by means of latches on the weights); U.S. Pat. No. 5,769,762 to Towley, III et al. (discloses various weight assemblies having a plurality of interconnected opposite side weights which are stored in nested relationship to one another and selectively connected to a handle by various means); and U.S. Pat. No. 5,839,997 to Roth et al. (discloses a dumbbell assembly having opposite side weights which are maintained in alignment on a base and selectively connected to a handle by means of eccentric cams on a rotating selector rod.

SUMMARY OF THE INVENTION

The present invention provides exercise dumbbells which "self-adjust" in response to operation of at least one selector rod. Many of the features and advantages of the present invention will become apparent from the detailed description that follows.

BRIEF DESCRIPTION OF THE DRAWING

With reference to the Figures of the Drawing, wherein like numerals represent like parts and assemblies throughout the several views.

FIG. 4 is a top view of a first selector rod on the dumbbell of FIG. 1;

FIG. 5 is a top view of a second selector rod on the dumbbell of FIG. 1;

FIG. 6 is a top view of a third selector rod on the dumbbell of FIG. 1;

FIG. 7 is a top view of a fourth selector rod on the dumbbell of FIG. 1;

FIG. 8 is a top view of the selector rods of FIGS. 4–7 as arranged on the dumbbell of FIG. 1;

FIG. 35 is a top view of yet another dumbbell constructed according to the principles of the present invention;

FIG. 36 is a partially sectioned top view of the dumbbell of FIG. 35, with outside cover portions removed;

FIG. 37 is a top view of a first selector rod on the dumbbell on FIGS. 35–38;

FIG. 38 is a top view of a second selector rod on the dumbbell of FIGS. 35–36;

DETAILED DESCRIPTION OF THE PREFERRED EMBODIMENT

Figure 1:
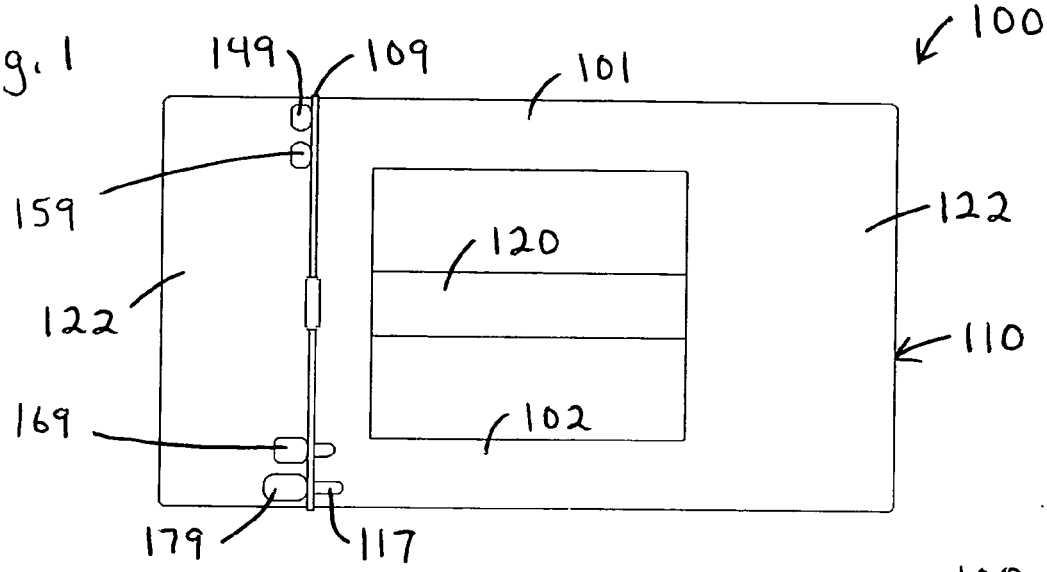
FIG. 1 is a top view of a dumbbell constructed according to the principles of the present invention.
Figure 2:
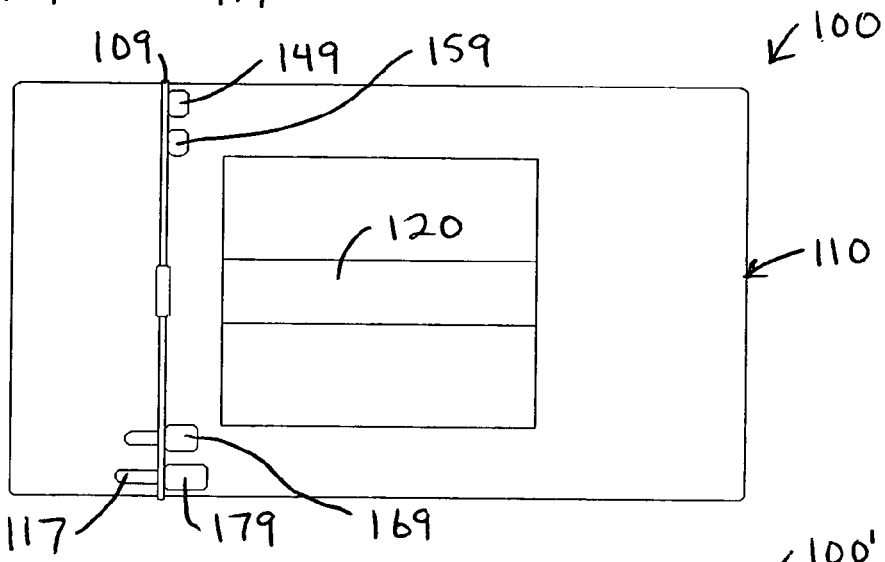
FIG. 2 is a top view of the dumbbell of FIG. 1 in a second configuration.
Figure 3:
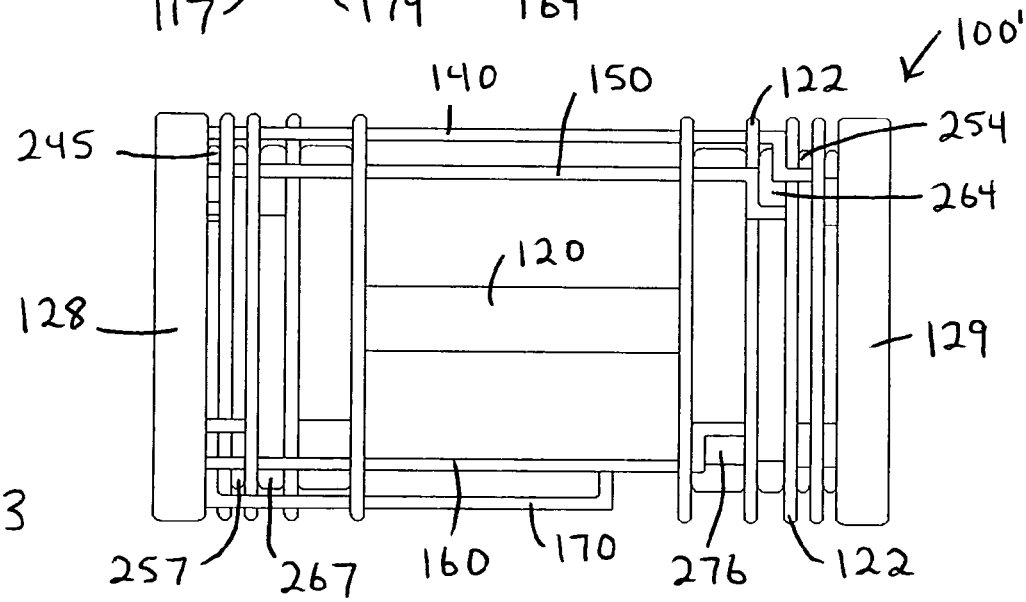
FIG. 3 is a top view of the dumbbell of FIG. 1 with outside cover portions removed.
Figure 9:
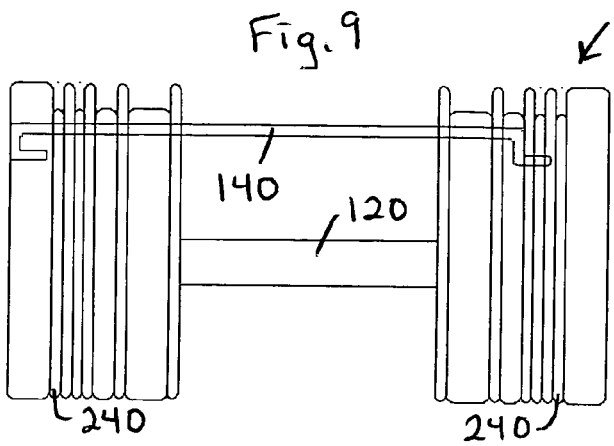
FIG. 9 is a front view of portions of the dumbbell of FIG. 3 shown in relation to the first selector rod.
Figure 10:
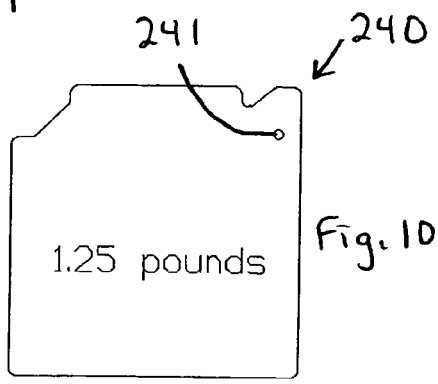
FIG. 10 is an end view of a weight plate configured for selection by the first selector rod.
Figure 11:
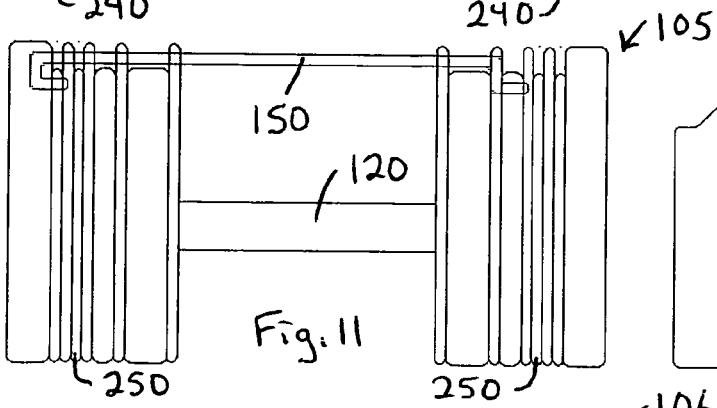
FIG. 11 is a front view of portions of the dumbbell of FIG. 3 shown in relation to the second selector rod.
Figure 12:
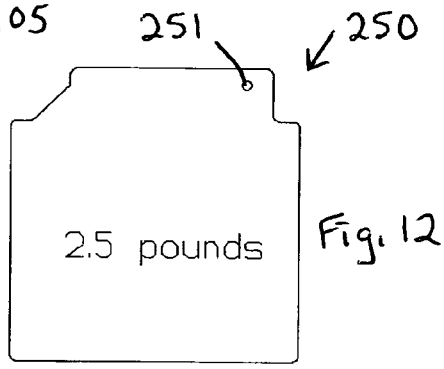
FIG. 12 is an end view of a weight plate configured for selection by the second selector rod.
Figure 13:
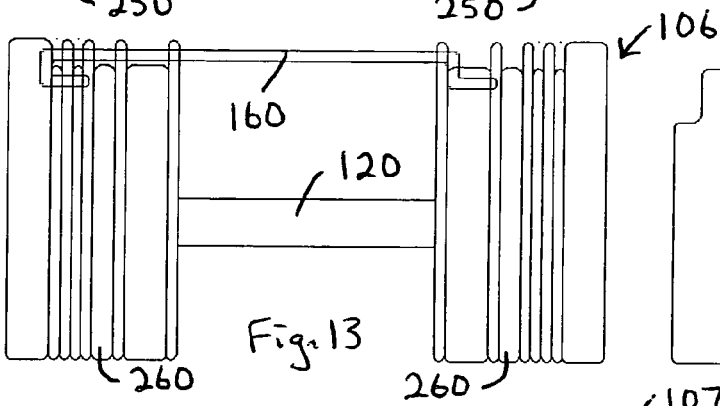
FIG. 13 is a front view of portions of the dumbbell of FIG. 3 shown in relation to the third selector rod.
Figure 14:
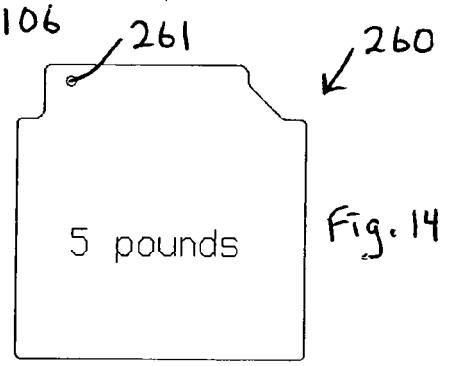
FIG. 14 is an end view of a weight plate configured for selection by the third selector rod.
Figure 15:
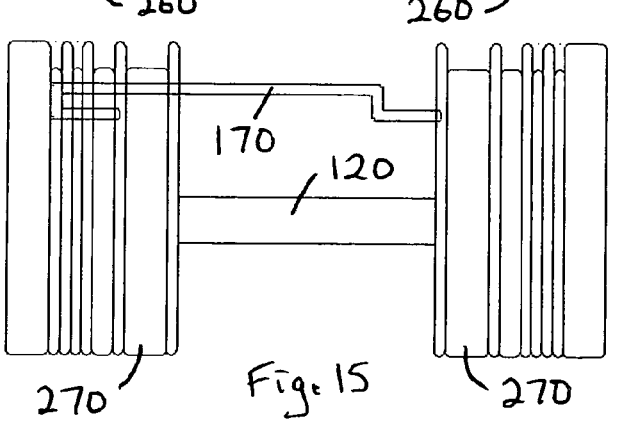
FIG. 15 is a front view of portions of the dumbbell of FIG. 3 shown in relation to the fourth selector rod.
Figure 16:
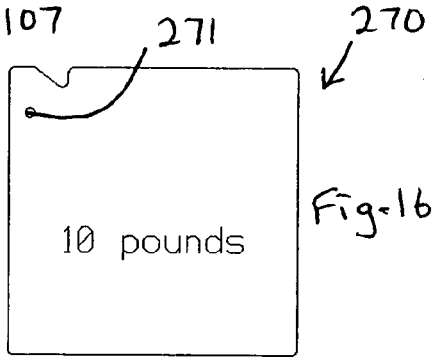
FIG. 16 is an end view of a weight plate configured for selection by the fourth selector rod.

U.S. Pat. No. 4,284,463 to Shields; U.S. Pat. No. 4,529,198 to Hettick, Jr.; U.S. Pat. No. 4,822,034 to Shields; U.S. Pat. No. 5,769,762 to Towley et al.; U.S. Pat. No. 5,839,997 to Roth et al.; U.S. Pat. No. 6,033,350 to Krull; and/or U.S. Pat. No. 6,099,442 to Krull are incorporated herein by reference because they disclose material which may contribute to understanding of the present invention, including, for example, ways to maintain the weights in axial alignment relative to a handle and/or a cradle.

FIGS. 1–24 show a first dumbbell constructed according to the principles of the present invention. The dumbbell 100 includes a base 110 and a dedicated selector rod 140, 150, 160, and 170 for each pair of available weights 240, 250, 260, and 270, respectively. Each selector rod is selectively movable between a weight engaging position and a free position, thereby facilitating sixteen different, balanced weight combinations.

The base 110 includes a force receiving member or handle 120 and first and second weight supporting boxes 122 rigidly secured to opposite ends of the handle 120. Supports or housings 101 and 102 are also rigidly secured between the boxes 122 to house intermediate portions of respective selector rods, as well as enhance the structural integrity of the base 100. Spacers or other suitable weight engaging means are provided within the boxes 122 to retain the weight plates in their respective axially spaced positions. The base 110 is configured to interact with a cradle that has similar spacers for purposes of holding any weight plates which are not in use.

The selector rods 140, 150, 160, and 170 are shown individually in FIGS. 4–7, respectively, and together in FIG. 8. The selector rod 140 includes an elongate intermediate segment 146; radially extending segments 143 and 144 secured to respective ends of the intermediate segment 146; and axially extending, distal end segments 141 and 142 secured to respective radially extending segments 143 and 144. The selector rod 150 similarly includes an elongate intermediate segment 156; radially extending segments 153 and 154 secured to respective ends of the intermediate segment 156; and axially extending, distal end segments 151 and 152 secured to respective radially extending segments 153 and 154. The selector rod 160 similarly includes an elongate intermediate segment 166; radially extending segments 163 and 164 secured to respective ends of the intermediate segment 166; and axially extending, distal end segments 161 and 162 secured to respective radially extending segments 163 and 164. The selector rod 170 similarly includes an elongate intermediate segment 176; radially extending segments 173 and 174 secured to respective ends of the intermediate segment 176; and axially extending, distal end segments 171 and 172 secured to respective radially extending segments 173 and 174.

Figures 17, 18, 19, 20, 21, 22, 23, 24:
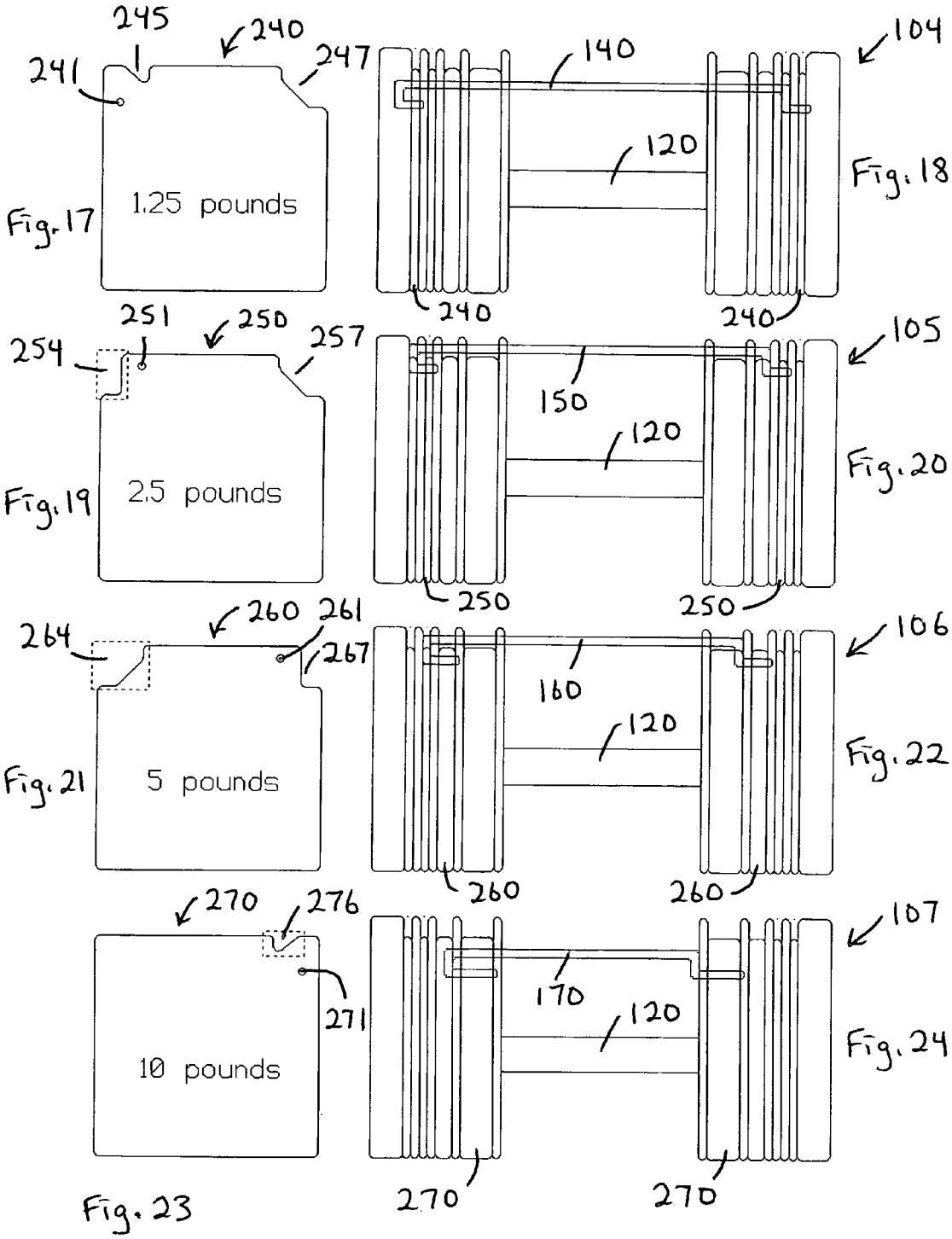
FIG. 17 is an opposite end view of the weight plate of FIG. 10.
FIG. 18 is a front view similar to FIG. 9, but with the first selector rod moved to an engaging position relative to the weight plate of FIG. 17.
FIG. 19 is an opposite end view of the weight plate of FIG. 12.
FIG. 20 is a front view similar to FIG. 11, but with the second selector rod moved to an engaging position relative to the weight plate of FIG. 19.
FIG. 21 is an opposite end view of the weight plate of FIG. 14.
FIG. 22 is a front view similar to FIG. 13, but with the third selector rod moved to an engaging position relative to the weight plate of FIG. 21.
FIG. 23 is an opposite end view of the weight plate of FIG. 16.
FIG. 24 is a front view similar to FIG. 15, but with the fourth selector rod moved to an engaging position relative to the weight plate of FIG. 23.

FIGS. 9, 11, 13, and 15 show partially assembled dumbbell units 104, 105, 106, and 107 with respective selector rods 140, 150, 160, and 170 in free positions relative to respective weight plates 240, 250, 260, and 270. FIGS. 18, 20, 22, and 24 show partially assembled dumbbell units 104, 105, 106, and 107 with respective selector rods 140, 150, 160, and 170 in weight engaging positions relative to respective weight plates 240, 250, 260, and 270. The plates weigh the respective amounts indicated in the Figures (the plate 240 is one-half as dense as the plate 250). The plates may be generally described as square plates having a hole to receive a respective selector rod and notches, where appropriate, to accommodate other selector rods. More specifically, the weight plate 240 is provided with a hole 241 to facilitate engagement by the selector rod 140; a relatively small notch 245 to accommodate the selector rod 150; and a relatively large notch 247 to accommodate the selector rods 160 and 170. The weight plate 250 is provided with a hole 251 to facilitate engagement by the selector rod 150; a relatively small notch 254 to accommodate the selector rod 140; and a relatively large notch 257 to accommodate the selector rods 160 and 170. In FIG. 19, the "dashed-line" box is indicative of the fact that the notch 254 is required for only the right end of the dumbbell 100 shown in FIGS. 9 and 18. However, economies of scale, as well as balance issues, mitigate in favor of similar configurations for both plates of a particular weight.

The weight plate 260 is provided with a hole 261 to facilitate engagement by the selector rod 160; a relatively small notch 267 to accommodate the selector rod 170; and a relatively large notch 264 to accommodate the selector rods 140 and 150. In FIG. 21, the "dashed-line" box is indicative of the fact that the notch 264 is required for only the right end of the dumbbell 100 shown in FIGS. 9, 11, 18, and 20. The weight plate 270 is provided with a hole 271 to facilitate engagement by the selector rod 170; and a relatively small notch 276 to accommodate the selector rod 160. In FIG. 23, the "dashed-line" box is indicative of the fact that the notch 276 is required for only the left end of the dumbbell 100 shown in FIGS. 15 and 24.

A respective button 149, 159, 169, and 179 is rigidly connected to each selector rod 140, 150, 160, and 170 by means of a respective post extending through a respective slot in the base 110. The longest such slot is designated as 117 in FIGS. 1–2. The positions of the buttons 149, 159, 169, and 179 in FIG. 1 correspond to the positions of respective selector rods 140, 150, 160, and 170 in respective FIGS. 9, 11, 13, and 15. The positions of the buttons 149, 159, 169, and 179 in FIG. 2 correspond to the positions of respective selector rods 140, 150, 160, and 170 in respective FIGS. 18, 20, 22, and 24. An elastic strap 109 extends across the base 110 between the two available positions for each of the buttons 149, 159, 169, and 179, to discourage undesired movement of same. An intermediate portion and both ends of the strap 109 are secured to the base 110. A respective portion of the strap 109 must be pulled away from the base 110 to accommodate movement of a particular button between its FIG. 1 position and its FIG. 2 position. Both the buttons 179 and 169 and their associated slots are relatively longer in order to accommodate relatively greater travel of their associated selector rods 170 and 160.

In one sense, the embodiment 100 may be described in terms of a selector rod having opposite end portions which extend axially; and a radially offset, intermediate portion which is interconnected therebetween and also extends axially. In another sense, the embodiment 100 may be described in terms of a selector rod which extends past a first weight and selectively engages a second weight. In yet another sense, the embodiment 100 may be described in terms of a base having a handle and weight supports secured to opposite ends of the handle; pairs of weights sized and configured for engagement by respective weight supports at opposite ends of the handle; and a discrete selector rod for each of the pairs of weights, wherein each said selector rod is movable between engaged and disengaged positions relative to one of the pairs of weights.

Figures 25, 26, 27, 28, 29, 30, 31:
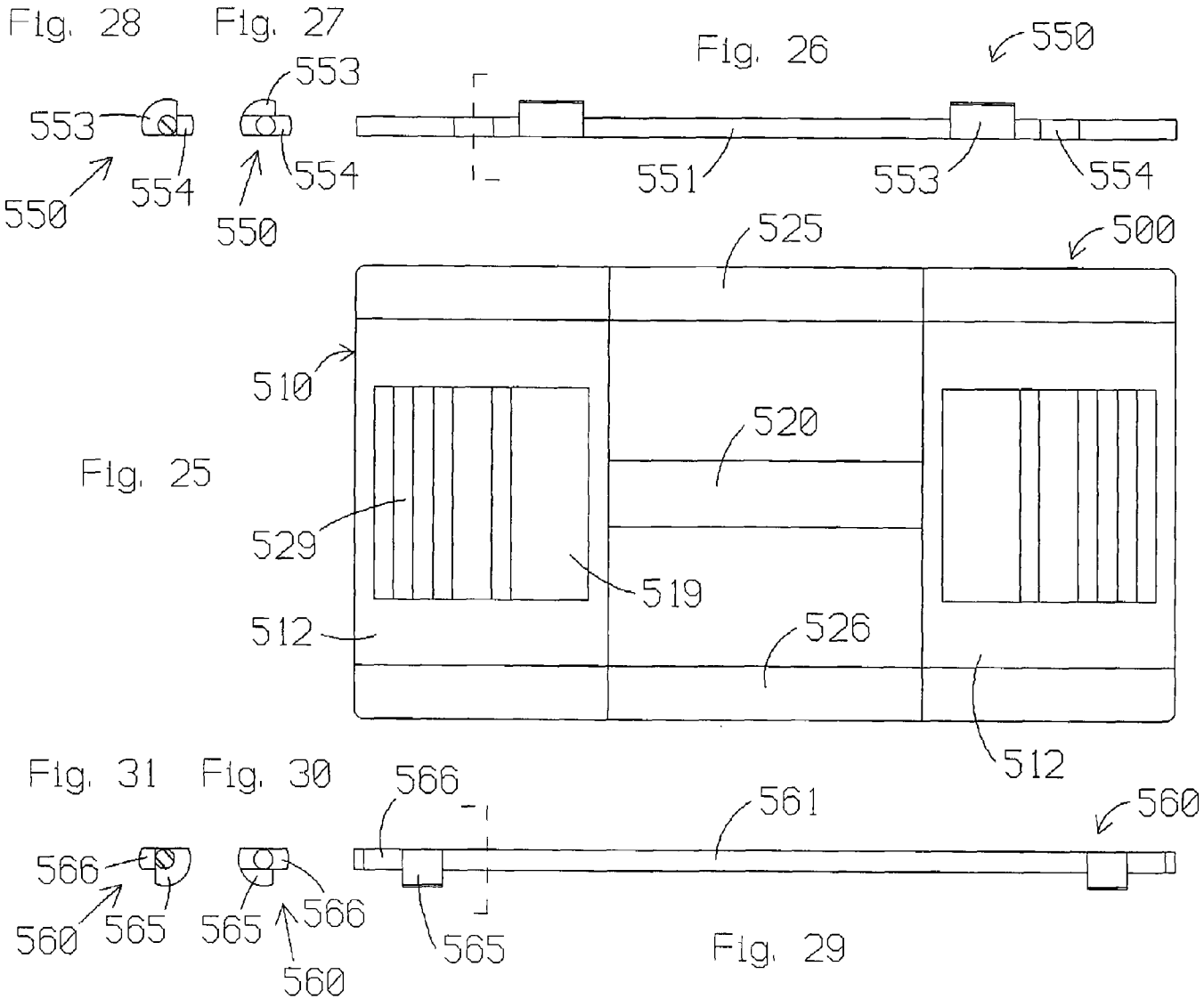
FIG. 25 is a top view of another dumbbell constructed according to the principles of the present invention.
FIG. 26 is a top view of a first selector rod on the dumbbell of FIG. 25.
FIG. 27 is an end view of the selector rod of FIG. 26.
FIG. 28 is a sectioned end view of the selector rod of FIG. 26.
FIG. 29 is a top view of a second selector rod on the dumbbell of FIG. 25.
FIG. 30 is an end view of the selector rod of FIG. 29.
FIG. 31 is a sectioned end view of the selector rod of FIG. 29.
Figure 33:
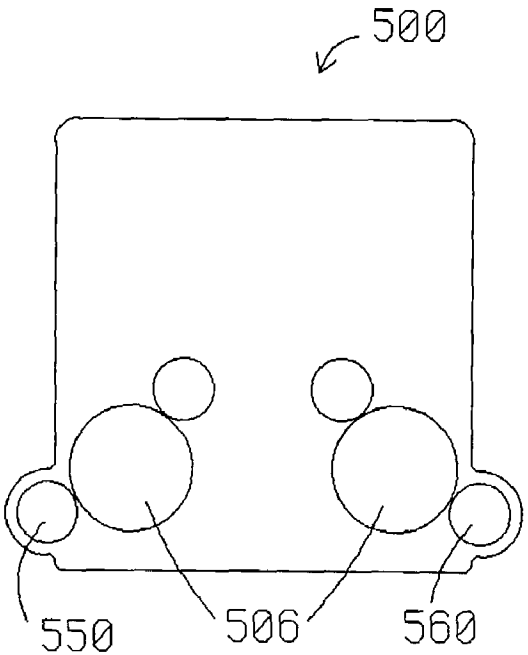
FIG. 33 is a diagrammatic, sectioned end view of the dumbbell of FIG. 25.
Figure 32:
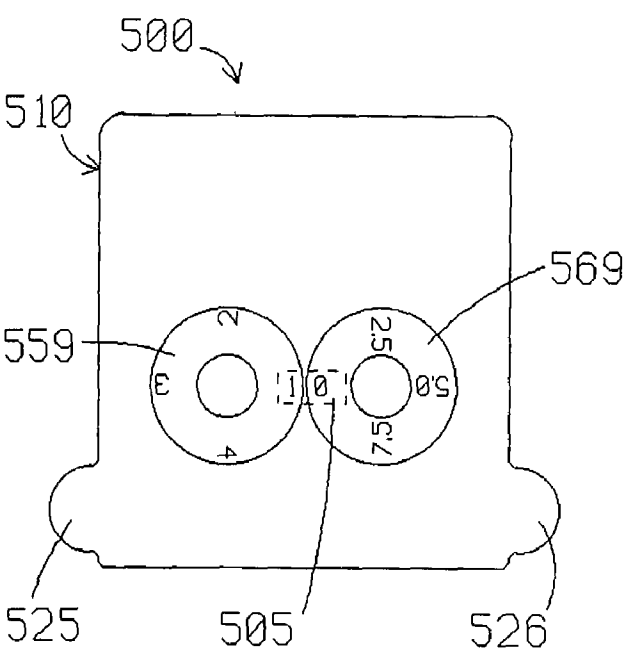
FIG. 32 is an end view of the dumbbell of FIG. 25.

Another dumbbell constructed according to the principles of the present invention is designated as 500 in FIGS. 25 and 32–33. The dumbbell 500 includes a force receiving member or handle 520 which is rigidly secured between opposite end weight supports 512. Opposite side tubular members or housings 525 and 526 are also rigidly interconnected between the weight supports 512 to house respective selector rods 550 and 560, as well as enhance the structural integrity of the base 510.

Figure 34:
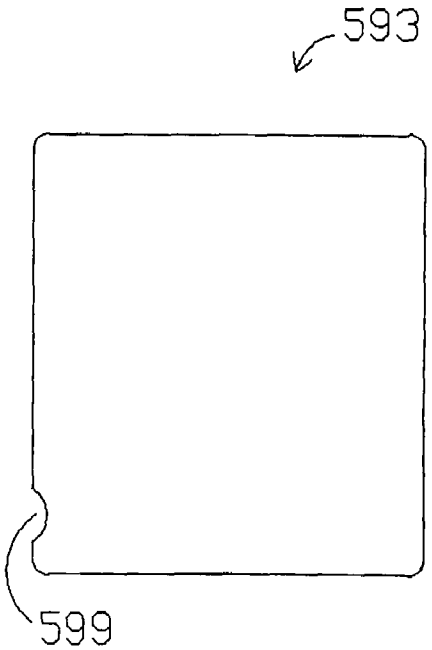
FIG. 34 is an end view of a weight plate on the dumbbell of FIG. 25.

Each weight support 512 includes an exterior shell disposed about a weight receiving compartment 519 that is divided into individual weight slots by interior spacers 529. As a result, each compartment 519 is configured to hold a single 10 pound weight, a single 5 pound plate, a single 2.5 pound plate, and a single 1.25 pound plate. Each of the weights has the profile of the weight 593 shown in FIG. 34. The profile of the weights may be described as generally square with rounded corners and an arcuate notch 599 extending into a side edge proximate a lower corner. The weights shown in FIG. 25 are arranged within the compartments 519 so that the notches 599 on each of the two heavier weights open toward FIG. 26, and the notches 599 on each of the two lighter weights open toward FIG. 29.

As shown in FIGS. 26–28, the selector rod 550 is an elongate rod 551 having a longitudinal axis and eccentric portions 553 and 554 projecting radially outward. The portions or cams 553 and 554 are bounded by arcs similar in size and shape to the notches 599 in the weights. The cams 553 are radially aligned with the 10 pound weights and project into the centers of two adjacent quadrants centered about the axis of the shaft 551. The cams 554 are radially aligned with the 5 pound weights and project into the centers of diametrically opposed quadrants centered about the axis of the shaft 551. The cams 553 and 554 are arranged so that neither projects into the quadrant nearest FIG. 25 when the selector rod 550 occupies the orientation shown. When so oriented, the selector rod 550 remains free and clear of all of the weights.

Rotation of the selector rod 550 ninety degrees clockwise (as viewed from the right end of the shaft 551 in FIG. 26) moves the cams 554 into the notches 599 in the 5 pound weights (and similar notches in the adjacent spacers 529), thereby selecting same for movement together with the base 510. Rotation of the selector rod 550 ninety more degrees in the same direction moves the cams 554 out of the notches in the 5 pound weights, and moves the cams 553 into the notches in the 10 pound weights (and similar notches in the adjacent spacers 529), thereby selecting the latter for movement together with the base 510. Rotation of the selector rod 550 ninety more degrees in the same direction moves the cams 554 into the notches in the 5 pound weights, and moves different portions of the cams 553 into the notches in the 10 pound weights, thereby selecting both the 5 pound weights and the 10 pound weights for movement together with the base 510. Rotation of the selector rod 550 ninety more degrees in the same direction returns the selector rod 550 to the orientation shown in FIG. 26. In other words, the selector rod 550 may be rotated to select any combination of the 5 pound weights and the 10 pound weights.

As shown in FIGS. 29–31, the selector rod 560 is configured in a manner similar to the selector rod 550. In particular, an elongate rod 561 has a longitudinal axis and eccentric portions 565 and 566 projecting radially outward. The portions or cams 565 and 566 are bounded by arcs similar in size and shape to the notches 599 in the weights. The cams 565 are radially aligned with the 2.5 pound weights and project into the centers of two adjacent quadrants centered about the axis of the shaft 561. The cams 566 are radially aligned with the 1.25 pound weights and project into the centers of diametrically opposed quadrants centered about the axis of the shaft 561. The cams 565 and 566 are arranged so that neither projects into the quadrant nearest FIG. 25 when the selector rod 560 occupies the orientation shown. When in this orientation, the selector rod 560 remains free and clear of all of the weights.

Rotation of the selector rod 560 ninety degrees clockwise (as viewed from the left end of the shaft 560 in FIG. 29) moves the cams 566 into the notches 599 in the 1.25 pound weights, thereby selecting same for movement together with the base 510. Rotation of the selector rod 560 ninety more degrees in the same direction moves the cams 566 out of the notches in the 1.25 pound weights, and moves the cams 565 into the notches in the 2.5 pound weights, thereby selecting the latter for movement together with the base 510. Rotation of the selector rod 560 ninety more degrees in the same direction moves the cams 566 into the notches in the 1.25 pound weights, and moves different portions of the cams 565 into the notches in the 2.5 pound weights, thereby selecting both the 1.25 pound weights and the 2.5 pound weights for movement together with the base 510. Rotation of the selector rod 560 ninety more degrees in the same direction returns the selector rod 560 to the orientation shown in FIG. 29. In other words, the selector rod 560 may be rotated to select any combination of the 1.25 pound weights and the 2.5 pound weights.

FIGS. 32 and 33 show diagrammatic left end views of the dumbbell 500. Knobs 559 and 569 may be connected to respective selector rods 550 and 560 by means of respective intermediate gears 506. The knobs 559 and 569 rotate at a one-to-one ratio together with respective selector rods 550 and 560. Indicia are provided on the knobs 559 and 569 and cooperate with one another to indicate (in the dashed-line box 505) the current weight of the base 510 as determined by the orientations of the selector rods 550 and 560. On the embodiment 500, the base 510 alone weighs 10 pounds, and the fully loaded base 510 weighs 47.5 pounds.

Various biasing and/or latching means may be used to bias the selector rods 550 and 560 (or those on other embodiments discussed herein) to remain in desired positions relative to the base 510. For example, spring-biased balls may be urged against the selector rods and into spaced apart depressions formed in same. Moreover, a locking device can be provided to prevent adjustment of the selector rods except when the base 510 is in a rest position on a weight supporting cradle.

The embodiment 500 may be described in terms of a selector rod which extends past a first weight and selectively engages a second weight. The embodiment 500 may also be described in terms of an adjustable exercise weight system, comprising: a base which includes a handle and weight supports at opposite ends of the handle; pairs of weights sized and configured for engagement with respective weight supports at respective ends of the handle; and a first selector rod mounted on one side of the base and rotatable into engagement with any combination of two different pairs of weights; and a second selector rod mounted on an opposite side of the base and rotatable into engagement with any combination of two other, different pairs of weights.

Yet another dumbbell constructed according to the principles of the present invention is designated as 600 or 600' in FIGS. 35–36 and FIGS. 39–41. The dumbbell 600 includes a force receiving member or handle 620 which is rigidly secured between opposite end weight supports 612 and 613. Opposite side channel members or housings 625 and 626 are also rigidly interconnected between the weight supports 612 and 613 to house respective selector rods 650 and 660, as well as enhance the structural integrity of the base 610. The end walls 628 and 629 of the base 610 are relatively thicker than the other dividing walls to keep the ends of the selector rods 650 and 660 from protruding beyond same.

Each of the weight supports 612 and 613 includes an exterior shell disposed about a weight receiving compartment which is divided into individual weight slots by interior spacers 615. On this embodiment 600, the two weight supports 612 and 613 are not mirror images of one another. Each of the resulting compartments 618 and 619 is configured to hold a single 10 pound weight. Each of the next largest compartments is configured to a single 5 pound plate. Each of the compartments 616 and 617 is configured to hold a single 2.5 pound plate. Each of the remaining compartments is configured to hold a single 1.25 pound plate. Each of the weights has a profile similar to the weight 593 shown in FIG. 34 (recognizing that the notch is preferably square instead of rounded).

Figure 39:
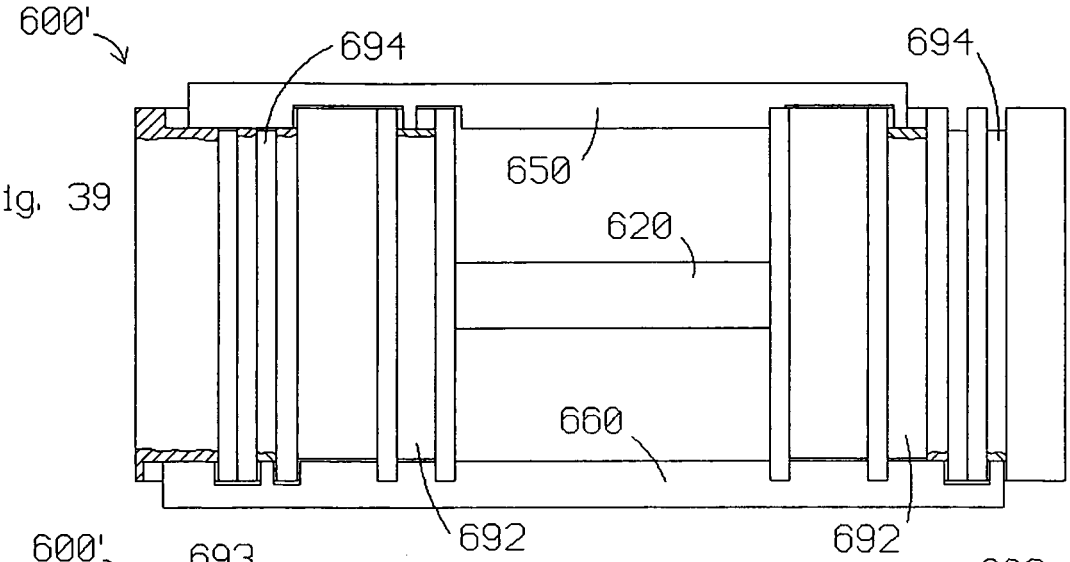
FIG. 39 is a top view of the dumbbell of FIG. 36 with the selector rods of FIGS. 37–38 moved to different positions.
Figure 40:
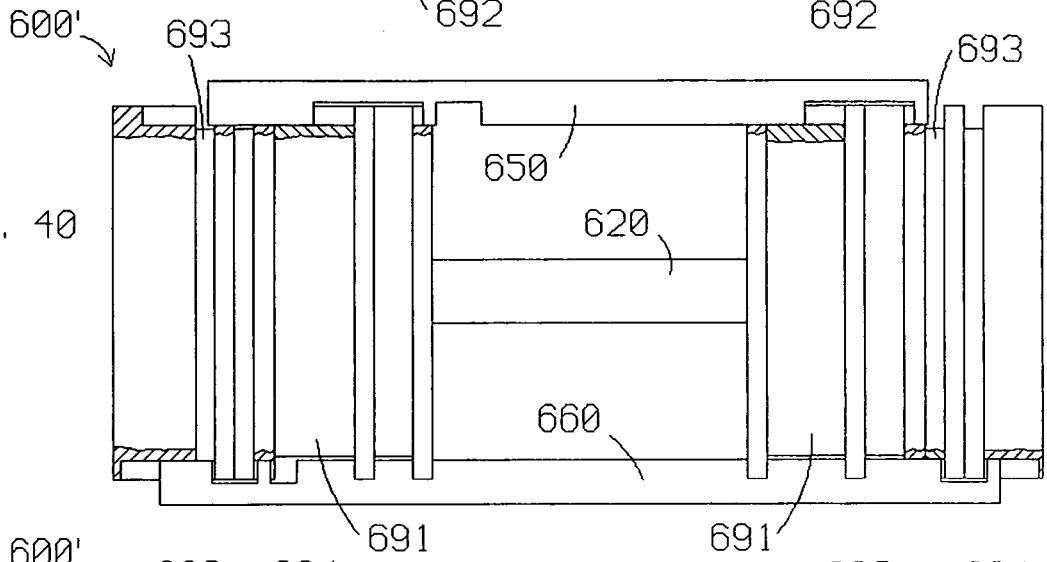
FIG. 40 is a top view of the dumbbell of FIG. 36 with the selector rods of FIGS. 37–38 moved to other different positions.
Figure 41:
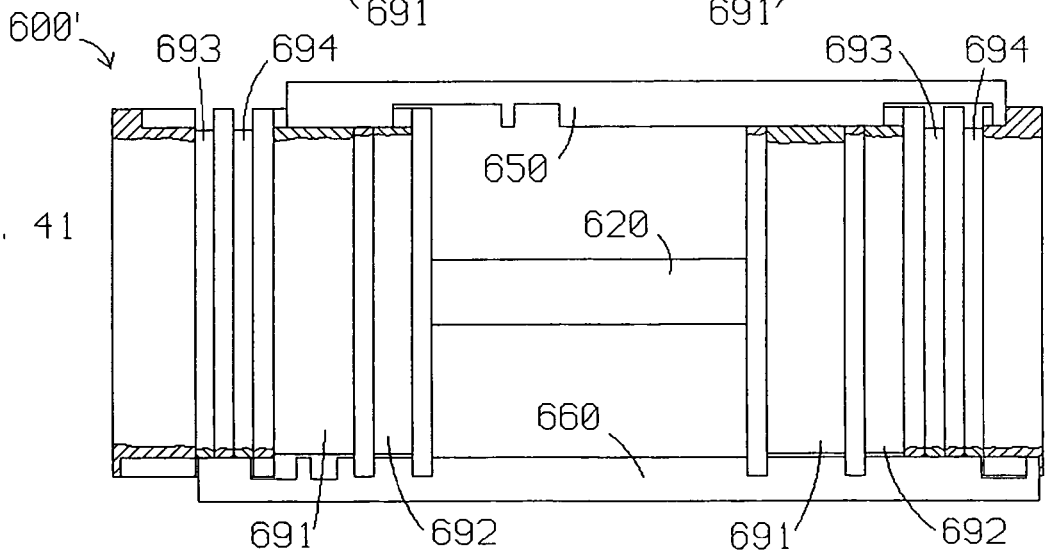
FIG. 41 is a top view of the dumbbell of FIG. 36 with the selector rods of FIGS. 37–38 moved to still other different positions.

As shown in FIG. 37, the selector rod 650 is an elongate rod having a longitudinal axis and eccentric portions 651, 653, 655, and 657 projecting radially outward, and/or notches 652, 654, and 656 projecting radially inward. The rod 650 is configured so that all portions thereof remain free and clear of the weights when the rod 650 occupies the position shown in FIG. 36. When the rod 650 is moved a first distance to the right, as shown in FIG. 39, the tabs 651 and 655 enter the notches in respective weights 692, thereby engaging same for movement together with the base 610. The weights 691 remain inside the confines of respective notches 652 and 656 and thus, are not selected. When the rod 650 is moved a second distance to the right, as shown in FIG. 40, the tabs 651 and 655 move beyond respective weights 692, thereby releasing same from the base 610, and the tabs 653 and 657 enter the notches in respective weights 691, thereby engaging same for movement together with the base 610. When the rod 650 is moved a third distance to the right, as shown in FIG. 41, the tabs 653 and 657 enter the notches in respective weights 692, and the tabs 653 and 657 remain within the notches in respective weights 691, thereby engaging both the weights 692 and the weights 691 for movement together with the base 610. In other words, the selector rod 650 is movable into engagement with any combination of the weights 691 and 692.

As shown in FIG. 38, the selector rod 660 is configured in a manner similar to the selector rod 650. In particular, the selector rod 660 is an elongate rod having a longitudinal axis and eccentric portions 661, 663, 665, and 667 projecting radially outward, and/or notches 662, 664, and 666 projecting radially inward. The rod 660 is configured so that all portions thereof remain free and clear of the weights when the rod 660 occupies the position shown in FIG. 36. When the rod 660 is moved a first distance to the right, as shown in FIG. 39, the tabs 661 and 665 enter the notches in respective weights 694, thereby engaging same for movement together with the base 610. The weights 693 remain inside the confines of respective notches 662 and 666 and thus, are not selected. When the rod 660 is moved a second distance to the right, as shown in FIG. 40, the tabs 661 and 665 move beyond respective weights 694, thereby releasing same from the base 610, and the tabs 663 and 667 enter the notches in respective weights 693, thereby engaging same for movement together with the base 610. When the rod 660 is moved a third distance to the right, as shown in FIG. 41, the tabs 663 and 667 enter the notches in respective weights 694, and the tabs 663 and 667 remain within the notches in respective weights 693, thereby engaging both the weights 694 and the weights 693 for movement together with the base 610. In other words, the selector rod 660 is movable into engagement with any combination of the weights 693 and 694.

The selector rods 650 and 660 are connected to respective buttons 640 that are selectively movable along respective members 625 and 626. Among other things, the buttons 640 are spring-biased toward the reader, so that tabs 642 are encouraged to enter and remain in respective openings 614, which correspond to the weight engaging positions of a respective selector rod 650 or 660. As a result, a button 640 must be pushed inward prior to movement along a respective channel 645 or 646 (and adjustment of a respective selector rod 650 or 660). The channel 645 is relatively longer because it is associated with relatively thicker weights 691 and 692.

The embodiment 600 may be described in terms of a selector rod which extends past a first weight and selectively engages a second weight. The embodiment 600 may also be described in terms of an adjustable exercise weight system, comprising: a base which includes a handle and weight supports at opposite ends of the handle; pairs of weights having notches formed therein, wherein the weights are sized and configured for engagement by respective weight supports at respective ends of the handle; and a selector rod having radially extending tabs, and slidably mounted on the base, so that the tabs are movable into the notches in desired pairs of weights. The foregoing system may include a second said selector rod to engage additional said pairs of weights and thereby provide a greater range of available weights for selection.

Although several specific embodiments are shown and described herein, this disclosure should not be considered as an exhaustive description of the subject invention and/or its many variations. For example, there are various known ways to support the weights when not in use and/or to maintain alignment of the weights relative to a cradle and/or a base. There are also many other ways to describe and/or claim various aspects of the present invention, including method claims based upon the disclosed embodiments. Accordingly, the scope of the present invention should be limited only to the extent of the following claims.

What is claimed is:

1. An exercise dumbbell, comprising:

a handle;

a first weight holder connected to a first end of the handle;

a second weight holder connected to an opposite, second end of the handle;

a first set of weight plates configured and arranged to occupy the first weight holder;

a second set of weight plates configured and arranged to occupy the second weight holder; and a selector rod slidably mounted relative to each said weight holder and selectively slidable beneath at least one weight plate in each said set of weight plates.

2. The exercise dumbbell of claim 1, wherein the selector rod is configured to underlie only a fraction of the weight plates in each said set.

3. The exercise dumbbell of claim 2, further comprising a second selector rod slidably mounted relative to each said weight holder and selectively slidable beneath a complementary fraction of the weight plates in each said set.

4. The exercise dumbbell of claim 1, further comprising means for latching the selector rod in a desired position relative to each said weight holder.

5. The exercise dumbbell of claim 1, wherein the selector rod is a bar with notches formed therein, and sliding of the bar to a first position places portions of the bar beneath the at least one weight plate in each said set, and sliding of the bar to a second position places the notches beneath the at least one weight plate in each said set.

6. The exercise dumbbell of claim 1, wherein the selector rod is a rod with an intermediate portion that defines a longitudinal axis, and opposite first and second end portions that extend parallel to the axis at a radial distance apart from the axis, and sliding of the bar to a first position places the end portions beneath the at least one weight plate in each said set, and sliding of the bar to a second portion removes the end portions from beneath the at least one weight plate in each said set.

* * * * *